United States Patent [19]

Syed et al.

[11] Patent Number: 4,563,244

[45] Date of Patent: Jan. 7, 1986

[54] APPARATUS FOR CONTROLLING DEPOSITION OF A LIQUID ONTO A MOVING SURFACE

[75] Inventors: Alexander Syed, London; Rowena Smillie, High Wycombe, both of England

[73] Assignee: The Wiggins Teape Group Limited, England

[21] Appl. No.: 554,696

[22] Filed: Nov. 23, 1983

[30] Foreign Application Priority Data

Nov. 24, 1982 [GB] United Kingdom ..... 8233569

[51] Int. Cl.[4] ..... D21F 1/02

[52] U.S. Cl. ..... 162/344; 162/336; 162/343; 118/407; 118/415

[58] Field of Search ..... 162/336, 337, 338, 343, 162/347, 346, 344; 118/407, 413, 415

[56] References Cited

U.S. PATENT DOCUMENTS

| | | | |
|---|---|---|---|
| 1,690,203 | 11/1928 | Niks | 162/347 |
| 2,203,802 | 6/1940 | Thaler | 162/344 |
| 3,233,575 | 2/1966 | Williams, Jr. | 162/344 |
| 3,310,461 | 3/1967 | Erbach | 162/336 |
| 4,125,429 | 11/1978 | Hergert et al. | 162/343 |
| 4,280,870 | 7/1981 | Bubik et al. | 162/343 |
| 4,345,970 | 8/1982 | Radvan et al. | 162/344 |
| 4,427,491 | 1/1984 | Radvan et al. | 162/344 |

*Primary Examiner*—S. Leon Bashore
*Assistant Examiner*—K. M. Hastings
*Attorney, Agent, or Firm*—Burns, Doane, Swecker & Mathis

[57] ABSTRACT

Apparatus is known for controlling the deposition of a liquid onto a moving surface comprising a reservoir having an outlet, and a curved guide member downwardly extending from above and adjacent to the outlet and having an underside onto which a jet of liquid can be discharged from the outlet, the guide member being oriented so as to be capable of causing liquid to flow down the member on its underside so that its direction of flow approaches the direction of travel of a moving surface. This invention is characterized in that two aprons are provided at the lower edge of the reservoir outlet so as to extend beneath the jet being discharged from the outlet, the first of the said aprons extending only part of the distance towards the moving surface and the second of the said aprons extending beneath the said apron so that the free end thereof is substantially in contact with the moving surface, the arrangement being such that the lower edge of the first apron is in engagement with the upper surface of the second apron.

8 Claims, 1 Drawing Figure

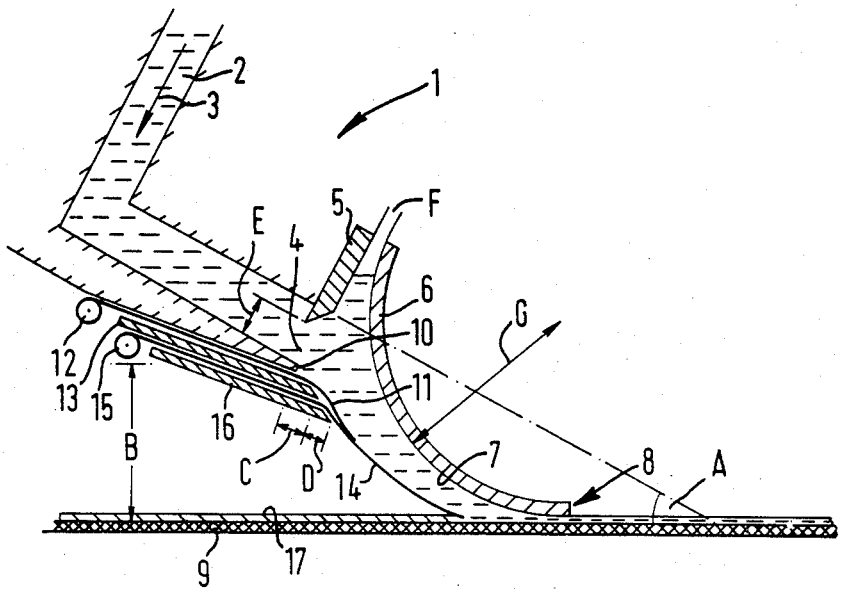
1
2
3
E
4
5
F
6
10
G
11
12
13
15
16
B
C
D
14
7
8
A
9
17

APPARATUS FOR CONTROLLING DEPOSITION OF A LIQUID ONTO A MOVING SURFACE

This invention relates to an improved apparatus for controlling the deposition of liquid onto a moving surface, and in particular to improvements in apparatus of this kind described and claimed in European Patent Publication No. 0015670A corresponding to U.S. Pat. No. 4,427,491.

In the aforementioned European Patent Publication, there is described an apparatus for controlling the deposition of a liquid onto a moving surface, comprising a reservoir having an outlet, and a curved guide member downwardly extending from above and adjacent to the outlet and having an underside onto which a jet of liquid can be discharged from the outlet, the guide member being oriented so as to be capable of causing liquid to flow down the member on its underside so that its direction of flow approaches the direction of travel of the moving surface.

In certain embodiments of such apparatus described in the aforementioned European Patent Publication, it is proposed to provide a flexible and impermeable apron extending from the lower edge of the opening and beneath the guide member substantially to the moving surface. The purpose of this apron is twofold. First it is intended to stabilize the jet, primarily by absorbing the downward pressure generated in the liquid at the outlet. Secondly it is intended to inhibit air entrainment by responding to the vacuum generated at the underside of the guide member so as to seal the liquid to air surface at the underside of the jet.

It has been found however that small variations in the pressure at the outlet and the force resulting from the vacuum can produce unstable conditions in which the free end of the apron tends to flap and permit the entrainment of air close to the moving surface.

It is among the objects of the present invention to provide an apron arrangement which alleviates the aforementioned problem.

The invention therefore provides an apparatus as above defined in which two aprons are provided at the lower edge of the reservoir outlet so as to extend beneath the jet being discharged from the outlet, the first of said aprons extending only part of the distance towards the moving surface and the second of said aprons extending beneath the first apron so that the free end thereof is substantially in contact with the moving surface, the arrangement being such that the lower edge of the first apron is in engagement with the upper surface of the second apron.

Means are provided for clamping the two aprons in their required positions. Each apron may be stored on a reel from which it can be unreeled to the extent required.

The purpose of the first apron is to absorb the downward pressure generated at the outlet so that the second apron can stabilize in contact with the jet and inhibit air entrainment at its lower edge.

Preferably the aprons are each made of flexible impermeable film, for example polyester film.

The invention will now be further described with reference to the accompanying drawing which is a semidiagrammatic sectional elevation of a paper machine headbox modified according to the invention.

Referring to the drawing, a headbox 1 is shown in which a papermaking dispersion 2 is maintained under pressure so as to flow in the direction of the arrow 3. The headbox terminates in an outlet 4 the dimensions of which are controllable by a parrot beak 5 which is adjustable transversely of the outlet.

Adjacent to the outlet, a downwardly extending guide member 6 is provided having a curved underside 7. A jet of the papermaking dispersion 2 projected from the outlet 4 is guided by the guide member 6 down its surface 7 and is deposited at 8 on a paper machine wire 9.

As so far described, the headbox and guide member configuration is essentially as described in European Patent Publication No. 15670A referred to above and reference should be had to that specification for a description of the principles of operation.

At the underside of the headbox, and close to the lower lip 10 of the outlet 4, a first apron 11 is provided so as to extend beneath the guide member 6 a short distance towards the paper machine wire 9. The apron 11 is stored on a reel 12 so as to be extendable as required and can be clamped in a desired position by a clamp of a conventional kind (not shown) which acts upon a clamping plate 13. Beneath the clamping plate 13, a second apron 14 is provided similarly stored on a reel 15 so as to be extendable beneath the first apron 11. The second apron 14 also extends beneath the guide member 6 but in this case as far as the paper machine wire 9. A further conventional clamp (not shown) acts upon a clamping plate 16 to clamp the apron 14 in the required position.

It has been found that adjustment of the aprons for optimum operation is achieved by fully extending both of the aprons 11 and 14 until they are near to engagement with the paper machine wire 9 or in engagement with a previously deposited fluid stock layer. Then, with papermaking dispersion being fed through the outlet 4 and down the guide member 6 onto the wire 9, the apron 11 is progressively retracted until the apron 14 ceases to flap. The clamping plates 13 and 16 are then clamped so as to retain the aprons 11 and 14 in the desired positions.

The setting of the apron 11 will vary in dependence upon the character of the papermaking dispersion, the pressure at which it is ejected through the outlet 4 and the positioning of the guide member 6.

EXAMPLE

A Fourdrinier paper making machine having a headbox assembly as shown in the drawing was used to prepare a paper web from an aqueous fibrous dispersion at a concentration of 0.5% solids by weight in which the fibrous content consisted of 50% hard wood and 50% soft wood sulphate pulps beaten to a wetness of 43° on the Schopper-Riegler scale.

Prior to preparation of the webs, the headbox was set so that the dimensions identified in the drawing were as follows:

Angle A: 21°
Dimension B: 30 mm
Dimension C: 3 mm
Dimension D: 3 mm
Outlet opening E: 8 mm
Dimension F: 12 mm
Radius G: 25 mm With the Fourdrinier wire running at a speed of 80 meters per minute, the dispersion 2 was deposited, via the guide member 6 onto a fluid stock layer 17 which had been previously deposited on the wire. After drying, it was found that the two-ply paper web which had been formed had a total substance of 60 grammes per square meter, showed a good formation, was streak free and was observed to contain no light areas resulting from the presence of air bubbles in the dispersion which had been deposited.

We claim:

1. Apparatus for controlling the deposition of a liquid onto a horizontally extending moving surface, comprising a reservoir spaced from and above said moving surface and having an outlet extending transversely of said surface, said outlet being defined by upper and lower edges, and a curved guide member extending downwardly from the upper edge of said outlet so as to present a downwardly convex face, for guiding a film of liquid projecting from said outlet down said face so that the direction of liquid flow approaches the direction of travel of the moving surface, the apparatus further comprising two flexible aprons extending substantially from the lower edge of the said outlet beneath and into engagement with the liquid film flowing down the guide member, the first of the said aprons extending only part of the distance towards the moving surface and having a lower edge, the second of the said aprons extending beneath the said first apron and having a free end substantially in contact with the moving surface, the arrangement being such that the lower edge of the first apron is in engagement with an upper surface on the second apron.

2. Apparatus as claimed in claim 1, in which means are provided for clamping the two aprons in their required positions.

3. Apparatus as claimed in claim 2 in which each apron is stored on a reel from which it can be unreeled to the extent required.

4. Apparatus as claimed in claim 1 in which the aprons are each made of impermeable film.

5. Apparatus as claimed in claim 4 in which the aprons are made from polyester film.

6. Apparatus as claimed in claim 2 in which the aprons are each made of impermeable film.

7. Apparatus as claimed in claim 3 in which the aprons are each made of impermeable film.

8. Apparatus for controlling the deposition of a liquid onto a horizontally extending moving surface, comprising a reservoir spaced from and above said moving surface and having an outlet extending transversely of said surface, said outlet being defined by upper and lower edges, and a curved guide member extending downwardly from the upper edge of said outlet so as to present a downwardly convex face, for guiding a film of liquid projecting from said outlet down said face so that the direction of liquid flow approaches the direction of travel of the moving surface, a first apron extending substantially from the lower edge of the said outlet beneath and into engagement with the liquid film flowing down the guide member, the first apron extending only part of the distance towards the moving surface and having a lower edge, the apparatus further comprising means for reducing flow induced instabilities at the lower edge, the means including a second flexible apron extending substantially from the lower edge of the said outlet beneath and into engagement with the liquid film flowing down the guide member, the second of the said aprons extending beneath the said first apron and having a free end substantially in contact with the moving surface, the arrangement being such that the lower edge of the first apron is in engagement with an upper surface on the second apron.

* * * * *